US010760386B2

(12) United States Patent
Yakimchuk et al.

(10) Patent No.: US 10,760,386 B2
(45) Date of Patent: Sep. 1, 2020

(54) SLANT WELL PUMPING UNIT

(71) Applicant: Weatherford Technology Holdings, LLC, Houston, TX (US)

(72) Inventors: Darius John Yakimchuk, St. Albert (CA); Jeffrey John Lembcke, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/965,718

(22) Filed: Apr. 27, 2018

(65) Prior Publication Data

US 2019/0330964 A1 Oct. 31, 2019

(51) Int. Cl.

| | |
|---|---|
| ***E21B 43/12*** | (2006.01) |
| ***F04B 47/02*** | (2006.01) |
| ***E21B 43/30*** | (2006.01) |

(52) U.S. Cl.

CPC ..... *E21B 43/127* (2013.01); *E21B 43/305* (2013.01); *F04B 47/022* (2013.01); *F04B 47/028* (2013.01); *E21B 2043/125* (2013.01)

(58) Field of Classification Search

CPC .... E21B 43/121; E21B 43/127; E21B 43/305; E21B 2043/125; F04B 47/02; F04B 47/022; F04B 47/028; F04B 47/14; Y10T 74/18182; Y10T 74/2156

See application file for complete search history.

(56) References Cited

U.S. PATENT DOCUMENTS

| | | | | |
|---|---|---|---|---|
| 1,761,330 | A * | 6/1930 | Davis | F04B 47/02 74/41 |
| 2,184,435 | A * | 12/1939 | Saxe | F16C 7/02 384/397 |
| 4,354,395 | A * | 10/1982 | Page, Jr. | E21B 17/07 74/41 |
| 4,520,683 | A | 6/1985 | Haverstock et al. | |
| 4,603,592 | A | 8/1986 | Siebold et al. | |

(Continued)

FOREIGN PATENT DOCUMENTS

| | | |
|---|---|---|
| CN | 1042053 C | 2/1999 |
| CN | 2391028 Y | 8/2000 |

OTHER PUBLICATIONS

Schlumberger, "Curved Beam Pumping Unit," Brochure, copyright 2017, 2-pgs.

(Continued)

*Primary Examiner* — Adam D Rogers
(74) *Attorney, Agent, or Firm* — Blank Rome, LLP

(57) ABSTRACT

A surface unit reciprocates a rod string for a downhole pump in a slanted well. The unit has a beam with a bend and pivots at a pivot between the bend and the horsehead of the beam. A post of the unit supports the pivot and is oriented to support the beam's load along the post and reduce bending stress. A crank arm is rotated by a prime mover about a crank point and translates pitman arms to oscillate the beam on the pivot, which reciprocates the rod string at surface along the slanted axis. The unit can be set at various offset distances relative to the intersection of the well so the unit can be used at various inclinations of slanted axis. The horsehead defines a segment with a face to accommodate at least 70% engagement or greater with the rod load for both largest and smallest inclinations.

22 Claims, 8 Drawing Sheets

(56) References Cited

U.S. PATENT DOCUMENTS

| | | | | |
|---|---|---|---|---|
| 5,528,947 | A | 6/1996 | Wang et al. | |
| 6,450,050 | B1 | 9/2002 | Luo et al. | |
| 7,406,887 | B2 * | 8/2008 | Jensen | F04B 47/022 185/33 |
| 8,240,221 | B2 | 8/2012 | Simpson et al. | |
| 10,094,371 | B2 * | 10/2018 | Mills | F04B 49/20 |
| 2016/0003234 | A1 * | 1/2016 | Mills | F04B 49/065 417/18 |
| 2017/0298923 | A1 * | 10/2017 | Gao | E21B 44/00 |

OTHER PUBLICATIONS

Weatherford, "Surface Pumping Units," Brochure, copyright 2017, 28-pgs.

* cited by examiner

SLANT WELL PUMPING UNIT

BACKGROUND OF THE DISCLOSURE

Reciprocating pump systems, such as sucker rod pump systems, extract fluids from a well and employ a downhole pump connected to a driving source at the surface. A rod string connects the surface driving force to the downhole pump in the well. When operated, the driving source cyclically raises and lowers the downhole pump, and with each stroke, the downhole pump lifts well fluids toward the surface.

For example, FIG. 1 shows a sucker rod pump system 10 used to produce fluid from a well. A downhole pump 14 has a barrel 16 with a standing valve 24 located at the bottom. The standing valve 24 allows fluid to enter from the wellbore, but does not allow the fluid to leave. Inside the pump barrel 16, a plunger 20 has a traveling valve 22 located at the top. The traveling valve 22 allows fluid to move from below the plunger 20 to the production tubing 18 above, but does not allow fluid to return from the tubing 18 to the pump barrel 16 below the plunger 20. A driving source (e.g., a pump jack or pumping unit 30) at the surface connects by a rod string 12 to the plunger 20 and moves the plunger 20 up and down cyclically in upstrokes and downstrokes.

During the upstroke, the traveling valve 22 is closed, and any fluid above the plunger 20 in the production tubing 18 is lifted towards the surface. Meanwhile, the standing valve 24 opens and allows fluid to enter the pump barrel 16 from the wellbore.

At the top of stroke, the standing valve 24 closes and holds in the fluid that has entered the pump barrel 16. Furthermore, throughout the upstroke, the weight of the fluid in the production tubing 18 is supported by the traveling valve 22 in the plunger 20 and, therefore, also by the rod string 12, which causes the rod string 12 to stretch. During the downstroke, the traveling valve opens, which results in a rapid decrease in the load on the rod string 12. The movement of the plunger 20 from a transfer point to the bottom of stroke is known as the "fluid stroke" and is a measure of the amount of fluid lifted by the pump 14 on each stroke.

At the surface, the pump jack 30 is driven by a prime mover 40, such as an electric motor or internal combustion engine, mounted on a pedestal above a base 32. Typically, a pump controller 60 monitors, controls, and records the pump unit's operation. Structurally, a Sampson post 34 on the base 32 provides a fulcrum on which a walking beam 50 is pivotally supported by a saddle bearing assembly 35.

Output from the motor 40 is transmitted to a gearbox 42, which provides low-speed, high-torque rotation of a crankshaft 43. Both ends of the crankshaft 43 rotate a crank arm 44 having a counterbalance weight 46. Each crank arm 44 is pivotally connected to a pitman arm 48 by a crank pin bearing 45. In turn, the two pitman arms 48 are connected to an equalizer bar 49, which is pivotally connected to the rear end of the walking beam 50 by an equalizer bearing assembly 55.

A horsehead 52 with an arcuate forward face 54 is mounted to the forward end of the walking beam 50. As is typical, the face 54 may have tracks or grooves for carrying a flexible wire rope bridle 56. At its lower end, the bridle 56 terminates with a carrier bar 58, upon which a polished rod 15 is suspended. The polished rod 15 extends through a packing gland or stuffing box at the wellhead 13. The rod string 12 of sucker rods hangs from the polished rod 15 within the tubing string 18 located within the well casing and extends to the downhole pump 14.

As is known, pump jack operating characteristics are typically characterized by the American Petroleum Institute ("API") Specifications, which expresses parameters as a function of the geometry of a pumping unit's four-bar linkage. Standardized API linkage geometry designates: dimension "A" as the distance from the center of the saddle bearing 35 to the centerline of the polished rod 15; dimension "C" as the distance from the center of the saddle bearing 35 to the center of the equalizer bearing 55; dimension "P" as the effective length of the pitman arm 48 as measured from the center of the equalizer bearing 55 to the center of the crank pin bearing 45; dimension "R" as the distance from the centerline 43 of the crankshaft to the center of the crank pin bearing 45; dimension "H" as the height from the center of the saddle bearing 35 to the bottom of the pump jack base 32; dimension "I" is the horizontal distance from the center of the saddle bearing 25 to the centerline 43 of the crankshaft; dimension "G" as the height from the centerline 43 of the crankshaft to the bottom of the pump jack base 32; and dimension "K" as the distance from the centerline 43 of the crankshaft to the center of the saddle bearing 35. Dimension "K" may be computed as:

$$K=\sqrt{(H-G)^2+I^2}$$

As is typical, the pump jack 30 as in FIG. 1 operates in conjunction with a vertically aligned wellhead 13. In some implementations, portions of a wellbore may be inclined or slanted from a vertical angle. In general, the slanted wellbore can penetrate fluid producing strata of a formation along a longer path for more exposure to the producing formation. Therefore, depending on the well's depth, the wellhead 13 at surface may also be inclined relative to vertical. The range of surface inclination typically varies between 0 and 45 degrees from vertical (i.e., between 90 and 45 degrees relative to the horizontal surface).

Apart from all of the complications downhole, the slanted wellhead and wellbore present problems for a traditional pump jack at surface. One configuration of a pump jack 30 for use with a slanted well having an inclined wellhead 13 is shown in FIG. 2A. (The same reference numerals are used for similar components described in previous figures.) This configuration is similar to that disclosed in U.S. Pat. No. 4,603,592. As shown, the wellhead 13 is inclined at an angle θ relative to the horizontal surface S. To direct the polished rod 15 through the slanted wellhead 13, the orientation of the walking beam 50 has been tilted. In particular, the pitman arms 48 have a longer length, the Sampson post 34 is tilted forward, and the horsehead 54 may be enlarged so that the pumping unit 30 can address the inclined wellhead 13.

This configuration alters the geometry of the four-bar linkage of the pump jack 30 so that the polished rod 15 can align with the inclined wellhead 13. Unfortunately, the alteration of the four-bar linkage may have a significant effect on the operating characteristics of the pumping unit 30, such as changing the allowable polished rod load, changing the shape of the permissible load envelope, altering the length of the pumping stroke, inducing a phase angle shift in the counterbalance, etc. Moreover, the change in operating characteristics at surface may further affect controls, analysis, diagnostics of the downhole rod pump because calculations for these features are typically based on the standard four-bar linkage (K-R-P-C).

Another configuration of a pump jack 30 for use with a slanted well having an inclined wellhead 13 is shown in FIG. 2B. (The same reference numerals are used for similar components described in previous figures.) This configuration is similar to that disclosed in U.S. Pat. No. 8,240,221. Instead of increasing the length of the pitman arms 48, this configuration has an elbow-shaped walking beam 50 to address the angled wellhead 13. The elbow shape is formed by a bend or elbow section 53 that defines forward and rearward sections of the beam 50. The bend 53 is located forward of the centerline of the center bearing 35.

The forward section of walking beam 50 is fabricated so its longitudinal axis is angled to address the inclination of the wellhead 13. In this way, the radius A from the centerline of the center bearing 35 to the arcuate face 54 of the horsehead 52 is tangent to the inclined polished rod 15. As disclosed, the non-linear bent walking beam 50 is described as providing a simple and effective means of addressing the angled wellhead 13 while preserving the operating characteristics of a prior art pumping unit. As also disclosed, the beam 50 is fabricated with the bend 53 that closes matches the wellhead angle. As further disclosed, the rearward section of the walking beam 50 from the saddle bearing 35 to the equalizer bearing 55, and the four-bar linkage system embodied by the pump jack, remains unchanged relative to a prior art pump jack intended for vertical wells.

Although slant well pump jacks of the prior art may have some benefits, operators are continually striving to increase the versatility of pump jack systems to meet the challenges of various implementations. The subject matter of the present disclosure is directed to overcoming, or at least reducing the effects of, one or more of the problems set forth above.

SUMMARY OF THE DISCLOSURE

A surface pumping unit disclosed herein is for reciprocating a rod load for a downhole pump in a well. The well has a wellbore axis intersecting at an inclination relative to surface. The unit comprises a frame and a beam. The frame is disposed at the surface and has a fulcrum point. The beam has first and second ends and defines a bend therebetween. The first end is connected to the rod load extending from the well at the inclination. The beam is pivotable at a pivot on the fulcrum point of the frame, and the pivot is disposed between the bend and the first end of the beam.

In one further configuration, the frame comprises a base and a post. The base is disposed at the surface, and the post extends from the base to the fulcrum point along an axial line from vertical. The first end of the beam comprises a straight section at the pivot of the fulcrum point, and the straight section is angled to intersect the axial line of the post at an acute forward angle. Orientation of the post, the straight section, and the pivot support a load of the beam with a force along the axial line reducing bending stress on the post.

In another further configuration, the unit comprises a head disposed on the first end of the beam. The head has a face circumscribing a segment at a radius relative to the fulcrum point, and the segment is tangential to the angles for the inclination of the wellbore axis. The unit is disposed at one of a plurality horizontal offsets from an intersection of the wellbore axis with the surface, and the face disposed with the base at the horizontal offsets accommodates a plurality of angles for the inclination of the wellbore axis.

The face can have a top end and a bottom end. At least seventy-percent or greater of the face from the top end can tangentially intersect the rod load along the wellbore axis for a largest of the angles of the inclination; and at least seventy-percent or greater of the face from the bottom end can tangentially intersect the rod load along the wellbore axis for a smallest of the angles of the inclination.

In various arrangements, the fulcrum point is disposed at a first vertical height (H) above the surface and is disposed at a horizontal offset from an intersection of the wellbore axis with the surface. The pivot can comprise a saddle bearing. The first end of the beam can comprise a first straight section having a first length, the second end of the beam can comprises a second straight section having a second length, and the bend can define an angle between the first and second straight sections and inclining the first straight section downward toward the frame.

In further configurations, the unit further comprises a prime mover, a crank arm, and a pitman arm. The prime mover is disposed adjacent the frame, and the crank arm connected to the prime mover is rotatable thereby about a crank point. The crank point is disposed at a first (K) dimension relative to the fulcrum point. The pitman arm has a second (P) dimension and connected between a first bearing point on the crank arm and a second bearing point on the second end of the beam. The first bearing point is disposed at a third (R) dimension from the crank point, and the second bearing point is disposed at a fourth (C) dimension relative to the fulcrum point. Therefore, the crank arm rotated by the prime mover about the crank point translates the pitman arm to oscillate the beam on the fulcrum point and reciprocates the rod load along the wellbore axis. In fact, the unit can have a pair of crank arms and pitman arms, and the pitman arms can connect with an equalizer bar at the second bearing point.

In various arrangements, the first bearing point comprises a crank pin bearing, and the second bearing point comprises an equalizer bearing. The crank arm comprises a counterweight disposed thereon, and the first bearing point is disposed between the counterweight and the crank point.

In the further configuration, the unit can be disposed at one of a plurality horizontal offsets from an intersection of the wellbore axis with the surface. In this way, the unit keeping the first, second, third, and fourth dimensions and disposed at the horizontal offsets can accommodate a plurality of angles for the inclination of the wellbore axis.

In the further configuration, the unit having the first, second, third, and fourth dimensions can operate at the inclination of the wellbore axis inclined from the surface comparable to a pumping unit having the first, second, third, and fourth dimensions that operates at a vertical wellbore axis.

According to the present disclosure, a surface pumping unit reciprocates a rod load for a downhole pump in a well. Again, the well has a wellbore axis intersecting at an inclination relative to surface. The unit comprises a base, a post, a beam, and a head. The base is disposed at the surface at one of a plurality horizontal offsets from an intersection of the wellbore axis with the surface. The post extends from the base to a fulcrum point along an axial line from vertical.

The beam has first and second ends and defines a bend therebetween. The beam is pivotable at a pivot on the fulcrum point of the frame. The pivot is disposed between the bend and the first end of the beam. The first end of the beam has a straight section at the pivot of the fulcrum point. The straight section is angled to intersect the axial line of the post at an acute forward angle; and The head is disposed on the first end of the beam and is connected to the rod load extending from the well at the inclination. The head has a face circumscribing a segment at a radius relative to the fulcrum point. The segment is tangential to the angles for the inclination of the wellbore axis. The face disposed with the base at the horizontal offsets accommodates a plurality of angles for the inclination of the wellbore axis.

The present disclosure disclosed a reciprocating pump system for a well having a wellbore axis intersecting at an inclination relative to surface. The system comprises a downhole pump disposed in the well and comprises a pumping unit disposed at the surface and coupled to the downhole pump by a rod string. The unit can include any of the various configurations outlined herein.

The foregoing summary is not intended to summarize each potential embodiment or every aspect of the present disclosure.

DETAILED DESCRIPTION OF THE DISCLOSURE

Figure 3A:
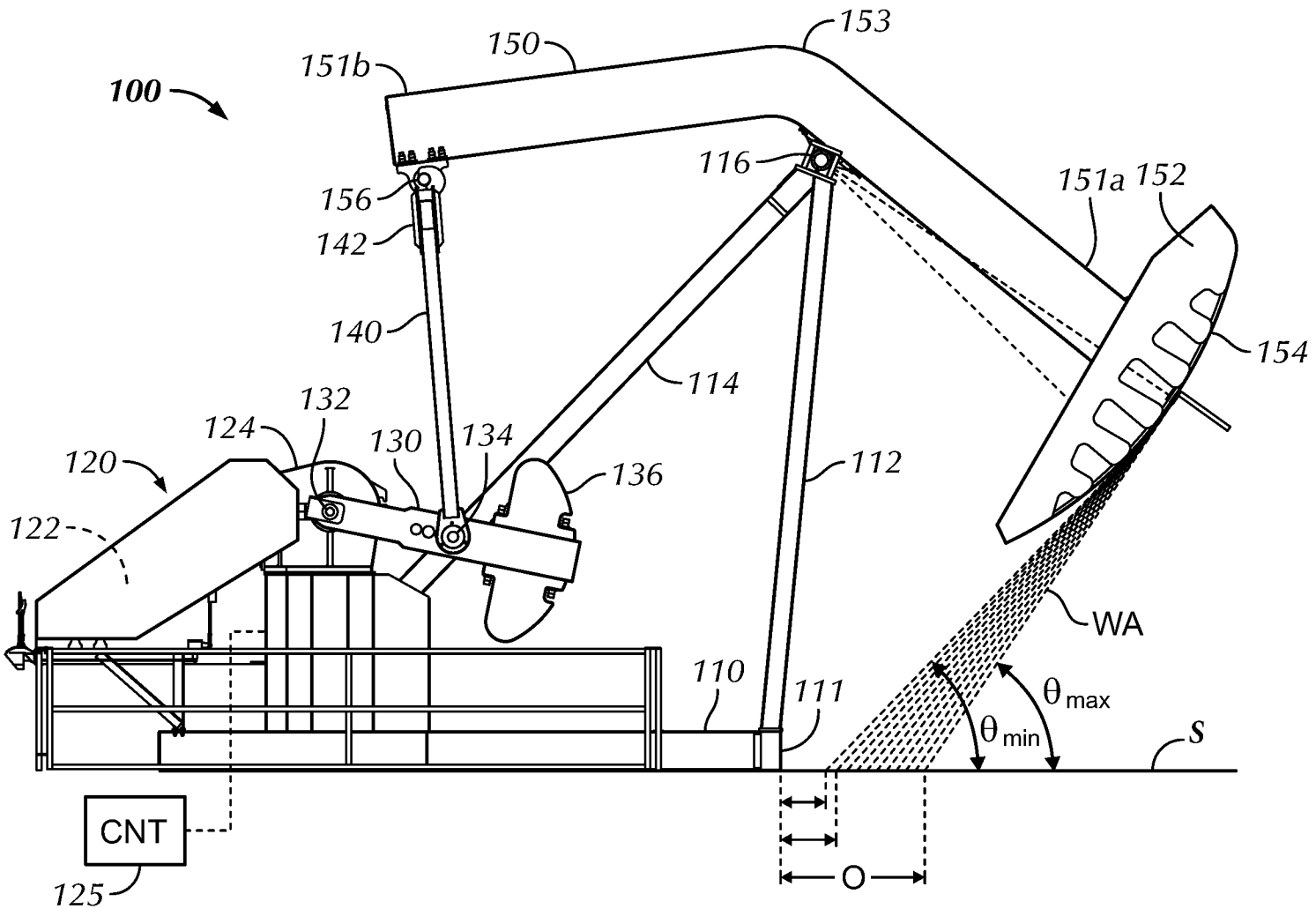
FIG. 3A illustrates an elevational view of a reciprocating rod pump system of the present disclosure for use with a slanted well.
Figure 3B:
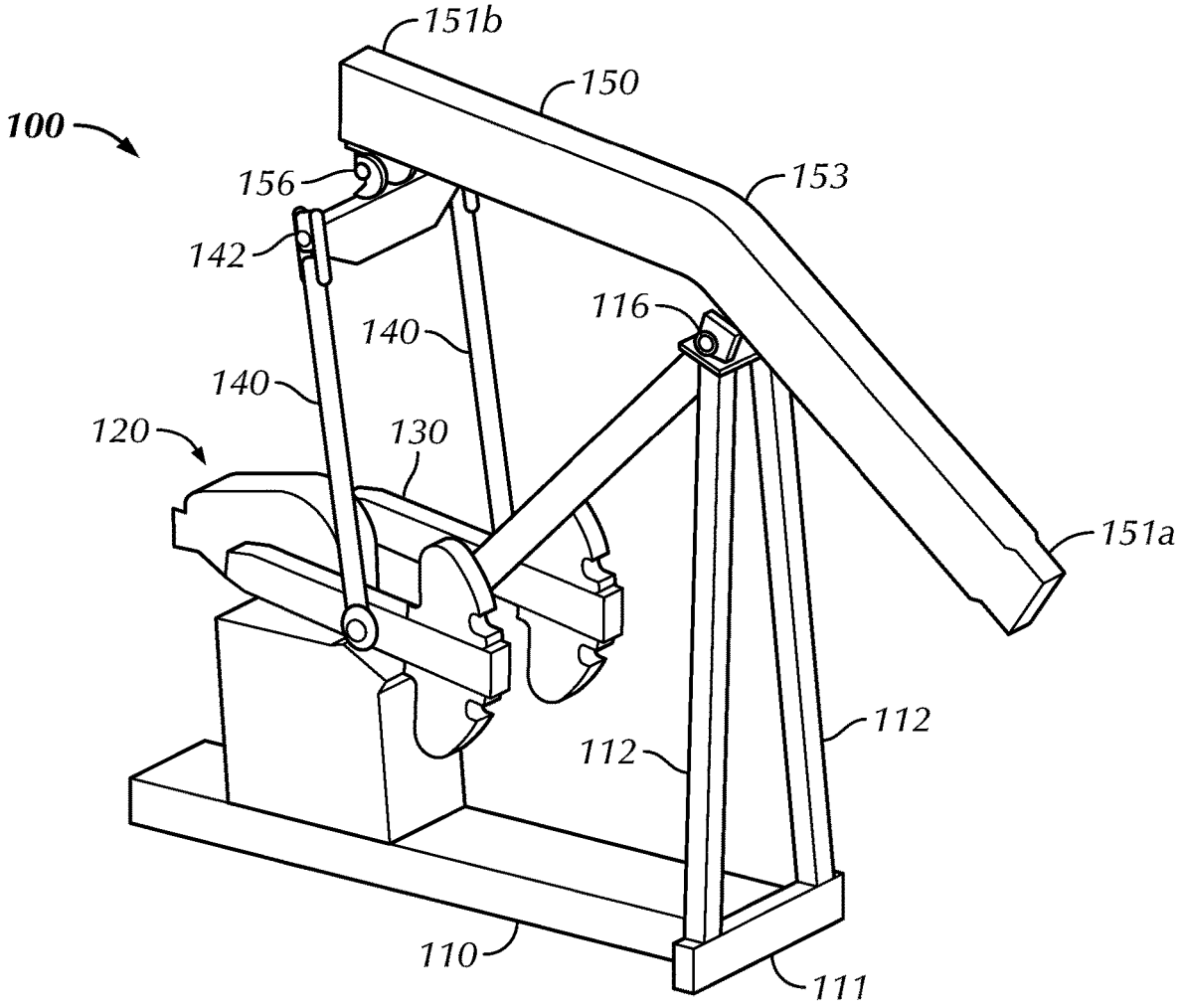
FIG. 3B illustrates a perspective view of the reciprocating rod pump system of the present disclosure.

Referring now to FIGS. 3A-3B, a surface pumping unit 100 according to the present disclosure is used for reciprocating a rod string for a downhole pump in a well where the rod string extends at an angle or inclination A at an intersection relative to the horizontal surface S. In other words, a polished rod connected to the rod string reciprocates along a wellbore axis WA through a slanted or inclined wellhead at the surface S. Details of the well, slanted wellhead, polished rod, rope bridle, carrier bar, downhole pump, and the like are not shown here for simplicity, but have been discussed previously.

The pumping unit 100 includes a frame having a base 110 and a Sampson post 112. An actuator 120 is disposed on the base 110, a crank assembly is connected to the actuator 120, and a walking beam 150 is connected to the crank assembly and is supported by the Sampson posts 112 on the base 110. Structurally, the Sampson posts 112 on the base 110 provide a fulcrum point on which the walking beam 150 is pivotally supported by a saddle bearing assembly 116. In addition to the Sampson posts 112, the frame on the base 110 may include one or more back posts 114 joined together forming an A-frame to support the walking beam 150.

The pumping unit 100 is driven by a prime mover 122, such as an electric motor or internal combustion engine, mounted on a pedestal above the base 110. A pump controller 125 monitors, controls, and records the pump unit's operation. Output from the motor 122 is transmitted to a gearbox 124, which provides low-speed, high-torque rotation of a crankshaft 132. Both ends of the crankshaft 132 rotate a crank arm 130 about the crankshaft's centerline. Disposed away from the crankshaft 132, the crank arms 132 each have a counterbalance weight 136. Each crank arm 130 is pivotally connected to a pitman arm 140 by a crank pin bearing 134. In turn, the two pitman arms 140 are connected to an equalizer bar or beam 142, which is pivotally connected to the rear end 151*b* of the walking beam 150 by an equalizer bearing assembly 156.

A horsehead 152 with an arcuate forward face 154 is mounted to the forward end 151*a* of the walking beam 150. As is typical, the face 154 may have tracks or grooves for carrying a flexible wire rope bridle (not shown). At its lower end, the bridle (not shown) terminates with a carrier bar (not shown), upon which a polished rod (not shown) for a reciprocating rod system is suspended. As before, the polished rod typically extends through a packing gland or stuffing box at an inclined wellhead for connection to downhole sucker rods and pump.

As is typical and best shown in FIG. 3B, the pumping unit 100 may have two pitman arms 140 joined by an equalizer beam 142, which is connected to the walking beam 150 by the equalizer bearing assembly 156. Each pitman arm 140 is pivotably connected to one of the crank arms 130 by a crank pin assembly 134, also called a wrist pin.

As the actuator 120 rotates the crank arms 130, the walking beam 150 seesaws on the frame's bearing 116 so the polished rod reciprocates the rod system and downhole pump in the well. During operation, for example, the motor 122 and gearbox 124 rotates the crank arms 130, which causes the rearward end 151*b* of the walking beam 150 to move up and down through the pitman arms 140. Up and down movement of the rearward end 151*b* causes the walking beam 150 to pivot about the bearing assembly 116 resulting in downstrokes and upstrokes of the horsehead 152 on the forward end 151*a*.

During an upstroke, for example, the motor 122 and gearbox 124 aided by the counterbalance weights 136 overcomes the weight and load on the horsehead 152 and pulls the polished rod string up from the wellbore, which reciprocates the rod string and downhole pump in the well to lift fluid. During a downstroke, the motor 122 aided by the weight and load on the horsehead 154 rotates the crank arms 130 to raise the counterbalance weights 136.

The counterbalance weight 136 is selected based on the weight and load of the reciprocating rod system (i.e., the force required to lift the reciprocating rod and fluid above the downhole pump in the wellbore). In one embodiment, the counterbalance weight 136 may be selected so that one or more components of the pumping unit 100 have substantially symmetrical acceleration and/or velocity during upstrokes and downstrokes. The component may be any moving part of the pumping unit 100, such as the pitman arm 140, the wrist pin assembly 134, the crank arm 130, the equalizer beam 142, the walking beam 150, the horsehead 152, etc.

As can be seen in FIGS. 3A-3B, the walking beam 150 defines a bend 153 between the forward and rearward ends 151*a-b*. The bend 153 is situated between the rearward end 151*b* and the bearing 116 at the fulcrum point of the frame's Sampson posts 112 about which the beam 150 pivots.

Figure 1:
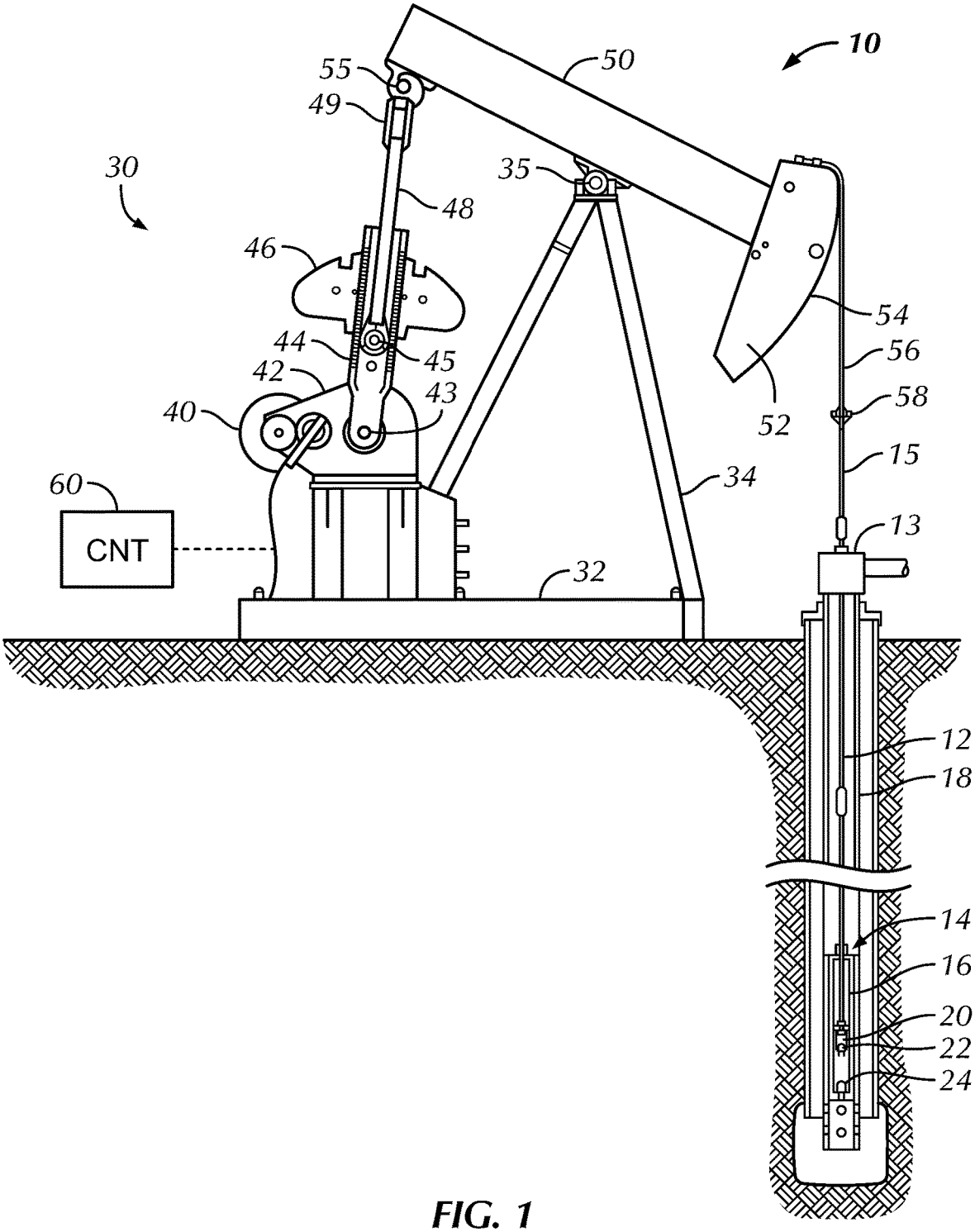
FIG. 1 (Prior Art)
FIG. 1 illustrates an example of a reciprocating rod pump system known in the art.
Figure 2A:
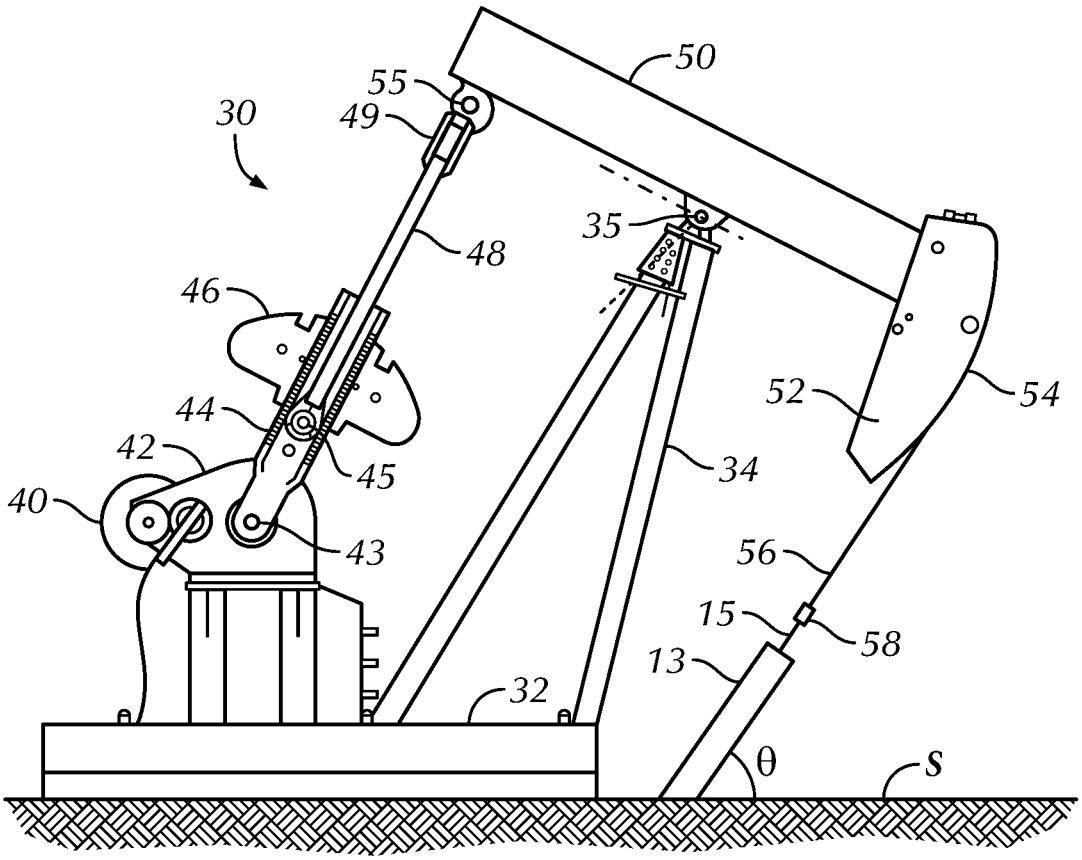
FIG. 2A (Prior Art)
FIG. 2A illustrates one type of reciprocating rod pump system of the prior art for use with a slanted well.
Figure 2B:
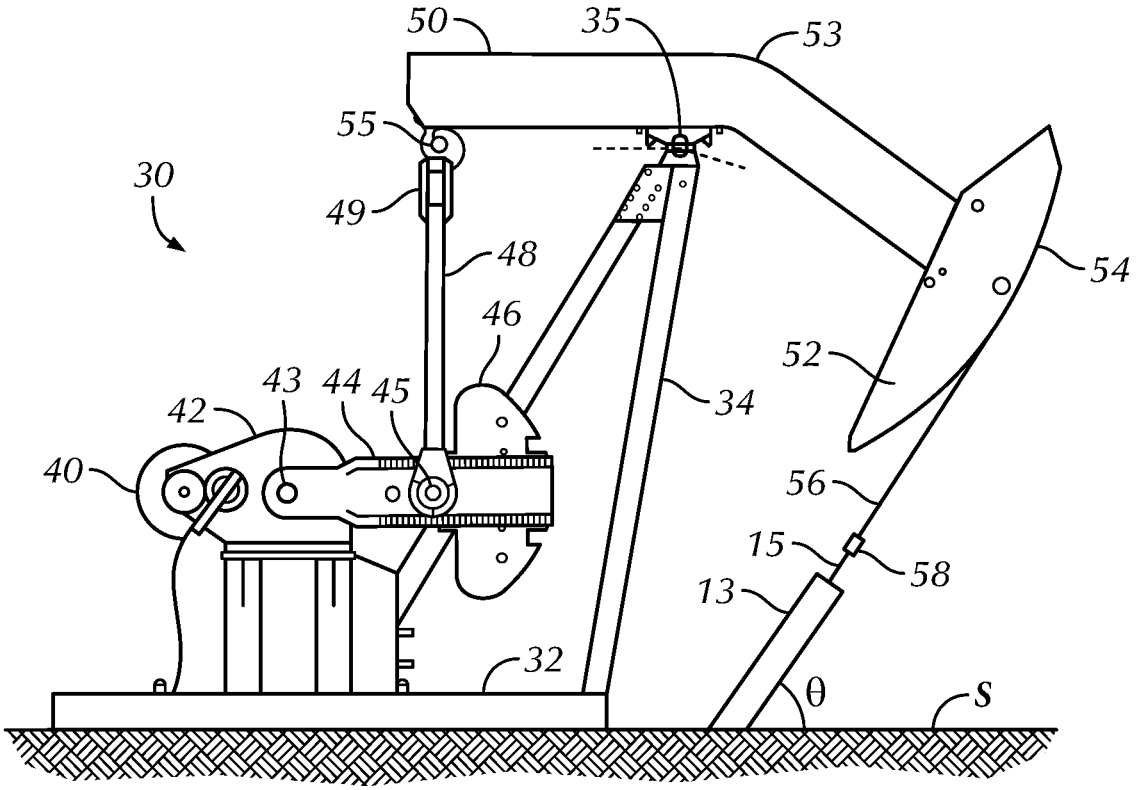
FIG. 2B (Prior Art)
FIG. 2B illustrates another type of reciprocating rod pump system of the prior art for use with a slanted well.

As can best be see in FIG. 3A, the position of the bend 153 behind the saddle bearing 116 offers structural advantages to the pumping unit 100. In particular, the bearing 116 engages the beam 150 at an angle more tangential to the straight section at the forward end 151*a*. This allows the bearing 116 to support the loads more directly and allows the loads from the bearing 116 to be supported more in line with the Sampson post 112. In this way, the Sampson posts 112 of the frame support compressive loads and are less subject to bending stresses in direct contrast to the Sampson posts 34 in the prior art arrangement of FIG. 2B.

Figure 4A:
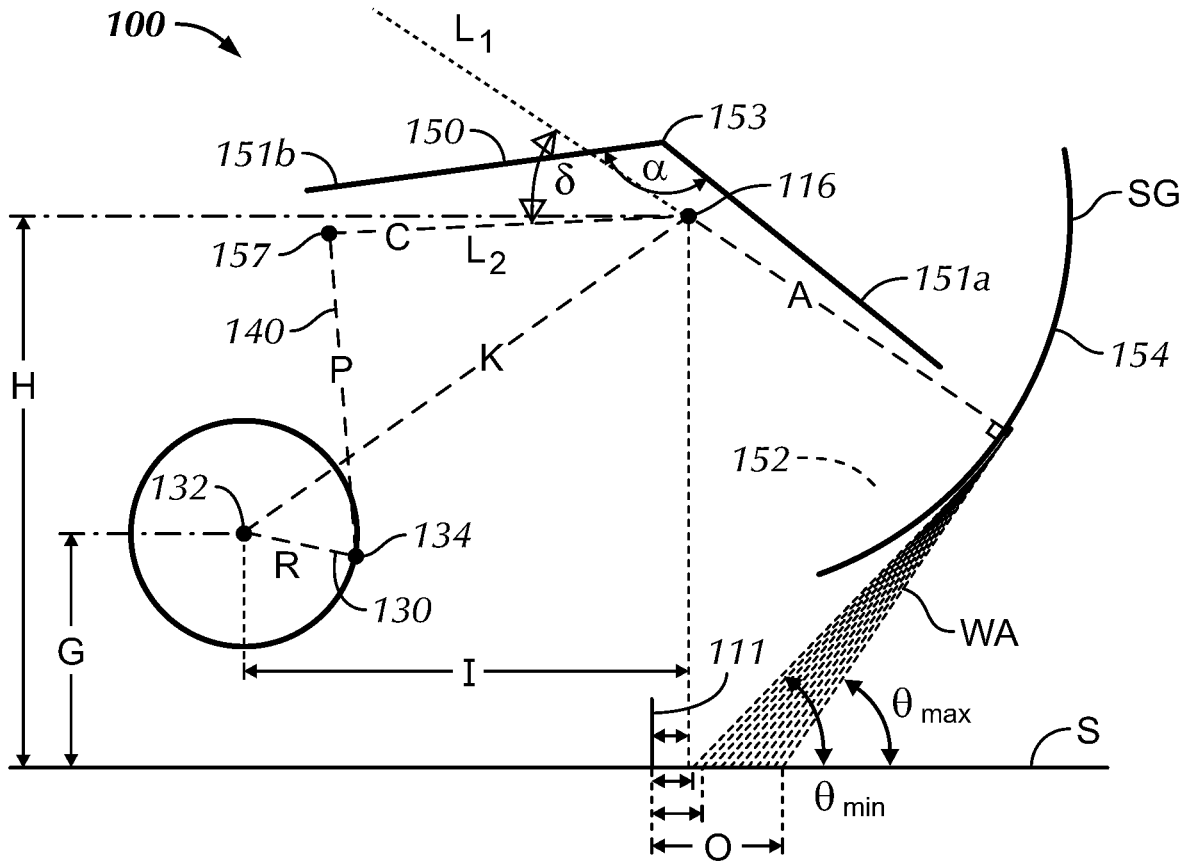
FIGS. 4A-4B illustrate the geometry of the disclosed reciprocating rod pump system.

The geometric arrangement of the unit 100 is schematically depicted in FIG. 4A. In this depiction, the frame, actuator, arms, and the like are not shown. Instead, the fulcrum point for the walking beam 150 is represented as a pivot point for the bearing assembly 116, and the bend 153 of the beam 150 is depicted reward of the pivot point 116 and on the opposite side thereof from the face 154 of the horsehead (152).

The face 154 connects to the polished rod extending along the wellbore axis WA from the wellhead at an inclination angle θ. The prime mover is not shown, but the crank arm 130 is connected to the prime mover at a crank point of the crank pin 132 and is connected to the pitman arm 140 at a first bearing point for the wrist pin 134. The pitman arm 140 is connected between the first bearing point 134 and a second bearing point 157 for the equalizer bearing assembly 156 on the walking beam 150.

The crank point 132 is disposed at a first dimension (K) relative to the fulcrum point 116 (i.e., the distance from the centerline of the crankshaft to the center of the saddle bearing), and the pitman arm 130 has a length of a second dimension (P) (i.e., the effective length of the pitman arm 130 as measured from the center of the equalizer bearing assembly 156 to the center of the crank pin bearing 134). The first bearing point 134 is disposed at a third dimension (R) from the crank point 132 (i.e., the distance from the centerline 132 of the crankshaft to the center of the crank pin bearing 134), and the second bearing point 157 is disposed at a fourth dimension (C) relative to the fulcrum point 116 (i.e., the distance from the center of the saddle bearing 116 to the center of the equalizer bearing 156). This completes the four-bar linkage of the unit 100.

Other geometric measures include the dimension (A), heights (H) and (G), and separation (I). The dimension (A) is the distance from the center of the saddle bearing 116 to the centerline of the polished rod represented by the wellbore axis WA and defines the radius at which the face 154 arcs along (circumscribes) a segment SG. As shown in FIG. 4A, the dimension (A)—as the radius of the segment SG—is perpendicular to the segment SG and extends along a first line ($L_1$) from the segment SG to the fulcrum point 116. As also shown in FIG. 4A, the dimension (C)—as the distance from the center of the saddle bearing 116 to the center of the equalizer bearing 156 (i.e., second bearing point 157)—extends along a second line ($L_2$), which is at an acute angle (δ) relative to the first line ($L_1$). The height (H) is the fixed elevation of the fulcrum point 116 from the surface S on which the base 110 is supported, and the height (G) is the fixed elevation of the crank point 134 from the surface S. Finally, the separation (I) is the fixed vertical distance between the fulcrum point 116 and the crank point 132.

As noted, the unit 100 operates as a kinematic four-bar linkage (KPRC), in which each of four rigid links (KPRC) is pivotally connected to two other of the four links (KPRC) to form a closed polygon. In the mechanism, the link (K) is fixed as the ground link. The two links (C, R) connected to the ground link (K) are referred to as grounded links, and the remaining link (P) not directly connected to the fixed ground link (K) is referred to as the coupler link. The grounded link (R) rotated by the prime mover about the crank point 132 translates the coupler link (P) arm to oscillate the grounded link (C) for the beam 150 on the fulcrum point 116. This in turn oscillates the radius (A) at which the face 154 arcs along (circumscribes) the segment SG.

In general, the unit 100 may have dimensions (C) and (A) that are increased compared to a comparable vertical well pumping unit. The head 152 also has a face 154 that may be longer compared to a comparable vertical well pumping unit. However, various dimensions are adjusted proportionally so that the unit 100 can operate comparably to the kinematic four-bar linkage (KPRC) used for a vertical well pumping unit. In this way, the disclosed unit 100 can use many of the same or similar components (i.e., motor 122, gearbox 124, crank arms 130, counterweights 136, pitman arms 140, control unit 125, and the like) as used for a comparable vertical well pumping unit. Even the saddle bearing 116 and the equalizer bearing 156 can be the same or similar. This provides the unit 100 with flexibility to meet the needs of various pumping implementations.

The forward section 151*a* of the beam 150 comprises a first straight section having a first length, and the rearward section 151*b* of the beam 150 comprises a second straight section having a second length. In one example, the bend 153 defines a bend angle $\alpha_{\square}$ of about 46-degrees between the first and second straight sections 151*a-b*, although the bend angle α can vary. The bend angle α can define the minimum inclination $\theta_{min}$ of the pumping unit 100. In general, the first length of the forward section 151*a* is longer than the second length of the rearward section 151*b*.

Because the walking beam 150 defines the bend 153 between rearward and forward portions 151*a-b* and because the forward section 151*a* has the head 152, the beam 150 defines a center of gravity that is more forward heavy. The center of gravity location can vary, however, based on the mass of the beam 150 and how that mass is distributed along its length following from the head 152, the forward portion 151*a*, the bend 153, and the rearward portion 151*b*.

The unit 100 with the same dimensions (K, P, R, C & A) outlined above can be disposed at a range of horizontal offsets (O) to accommodate a range of inclination angles θ relative to the vertical surface S. In general, the offset (O) could be measured from the edge 111 of the base 110, or it can be measured from the vertical location of the fulcrum point 116 or from some other given point.

The chart below provides example inclination angles θ at offsets (O) measured from the edge 111 of the base 110.

| Inclination Angles (deg) | Offset (mm) |
|---|---|
| 46 | 457 |
| 47 | 563 |
| 48 | 668 |
| 49 | 770 |
| 50 | 872 |
| 51 | 972 |
| 52 | 1071 |
| 53 | 1169 |
| 54 | 1267 |
| 55 | 1367 |
| 56 | 1459 |

Figure 4B:
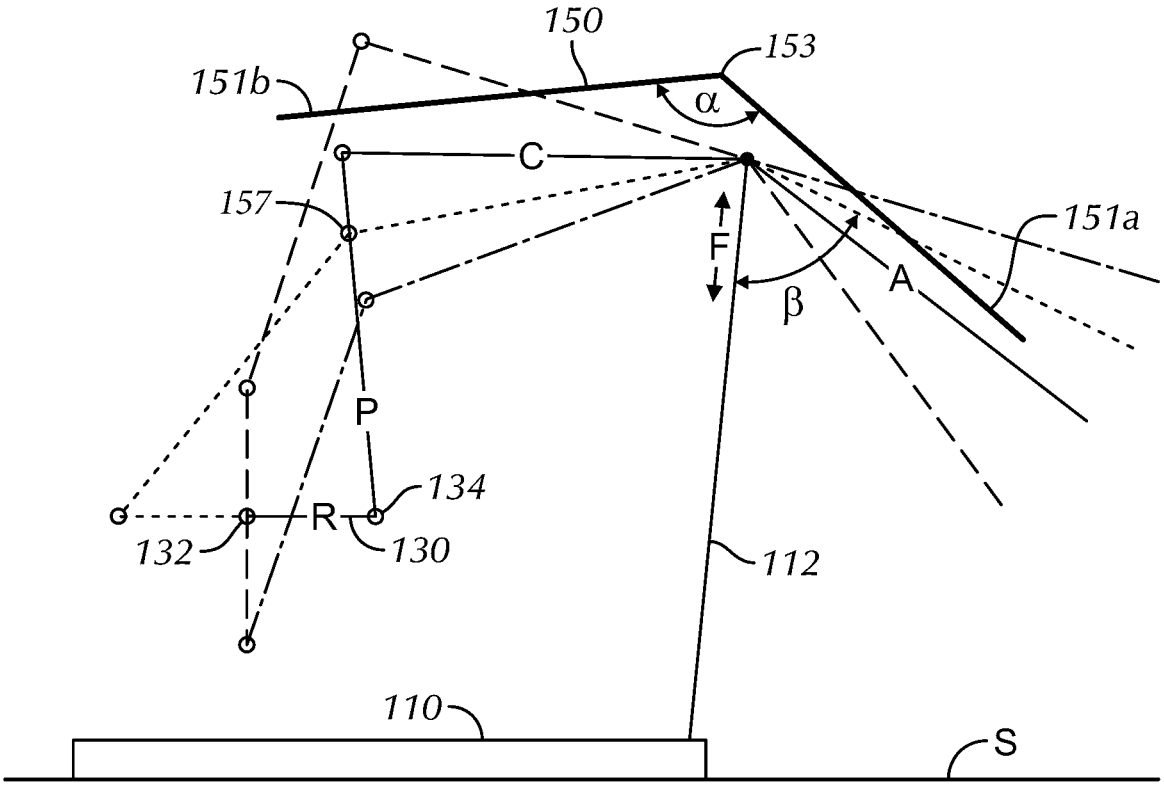

As shown in FIG. 4B, the base 110 of the frame is shown disposed at the surface S, and the Sampson post 112 extends from the base 110 to the fulcrum point 116 along an axial line from vertical. Various orthogonal rotations of the crank arm 130 with dimension (R) are shown translating the pitman arm 140 with dimension (P) and pivoting the links (C) and (A) of the beam 150. As disclosed herein, the first end 151*a* of the beam 150 includes a straight section 151*a* at the pivot of the fulcrum point 116. As the beam 150 reciprocates, the straight section 151*a* remains angled to intersect the axial line of the post 112 at an acute forward angle β (i.e., the angle situated forward of the saddle bearing 116 and defined at the intersection of the straight section 151*a* and the post 112). Accordingly, the orientation of the post 112, the straight section 151*a*, and the pivot of the fulcrum point 116 support a load of the beam 150 with a force F along the axial line. This tends to reduce bending stress on the post 112.

Figure 5A:
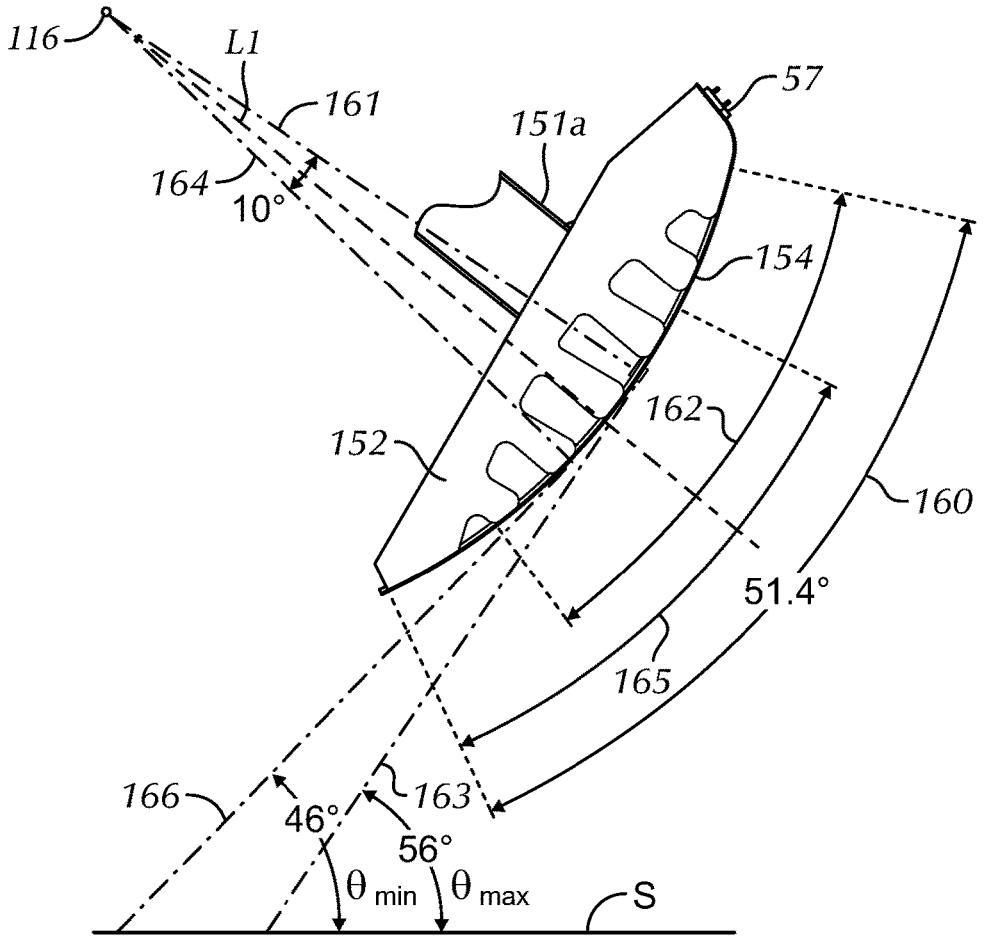
FIG. 5A illustrates the geometry of the horsehead of the disclosed reciprocating rod pump system.
Figure 5B:
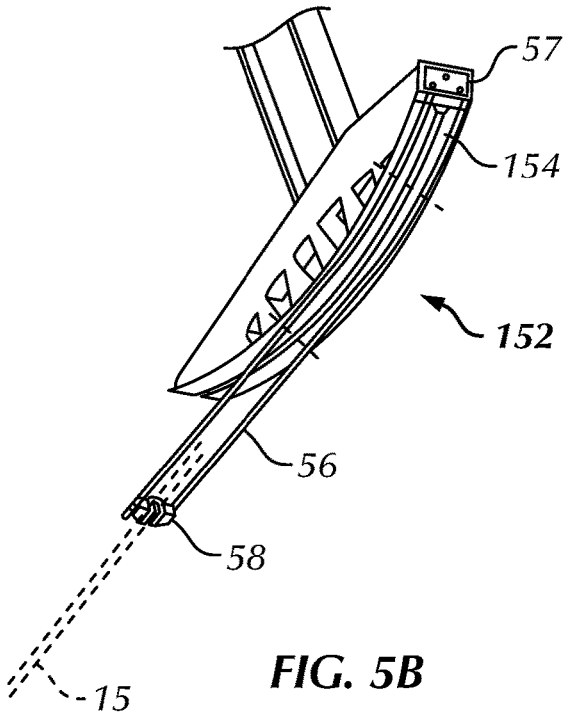
FIG. 5B illustrates a perspective view of elements of the horsehead of the disclosed reciprocating rod pump system.

Turning now to FIGS. 5A-5B, details of the horsehead 152 are discussed. To accommodate the various inclination angles θ, the horsehead 152 preferably includes a runner on its face 154 long enough and positioned so that a stroke for the smaller inclination angles $\theta_{min}$ runs on the bottom half of the head's face 154 whereas a stroke for the larger inclination angles $\theta_{max}$ runs on the upper half of the head's face 154. As shown in FIG. 5A, a maximum run area 160 on the face 154 is depicted for the greatest and smallest angles of inclination $\theta_{max}$, $\theta_{min}$ of the wellbore axis. Run area refers to the surface area of the face 154 at which the rope bridles make intersecting contact with the face as the head strokes. During at least part of the strokes, some of the bridles rest against the face, but successive tangential points along the lengths of the bridles lift and lay with changing engagement on the surface 154 as the horsehead 152 moves.

Line 161 shows a line that extends between the pivot 116 and a point on the face 154 at which the inclined line 163 of the greatest inclination angle $\theta_{max}$ is tangent, whereas line 164 shows another line that extends between the pivot 116 and another point on the face 154 at which the inclined line 165 of the smallest inclination angle $\theta_{min}$ is tangent. In general, the run area for the greatest inclination angle $\theta_{max}$ preferably encompasses an arc 162 on the upper face 152 of at least 70% or greater (preferably about 80% or greater) of the total run area 160. Similarly, the run area for the smallest inclination angle $\theta_{min}$ encompasses an arc 165 of at least 70% or greater (preferably about 80% or greater) of the total run area 160.

In the particular example shown, line 161 is perpendicular to the tangent for the largest inclination angle $\theta_{max}$ of 56-degress, and line 164 is perpendicular to the tangent for the smallest inclination angle $\theta_{min}$ of 46-degress. These two lines 161, 164 therefore define an arc of 10-degrees on the face 154 of the horsehead 152, each line 161, 164 being on either side of the first line ($L_1$) noted above. Overall, the maximum run area 160 of the horsehead can define the arc 160 of about 51.4-degrees. Therefore, the run area for the largest inclination angle $\theta_{max}$ encompasses the arc 162 of about 41.1-degrees—i.e., 20.7-degrees on either side of this point of tangency. Similarly, the run area for the smallest inclination angle $\theta_{min}$ encompasses the arc 165 of about 41.1-degrees—i.e., 20.7-degrees on either side of the point of tangency.

Typically, as shown in FIG. 5B, the face 154 of the horsehead 152 has rope bridles 56 affixing with a fixture 57 at the top end of the head 152. The rope bridles 56 flexibly run along and lift from the face 154 as the head 152 moves, and they connect to the polished rod 15 with a carrier bar 58. The changing engagement of the rope bridles 56 with the head 152 runs along the bottom 80% of the face 154 for the smallest inclination angle $\theta_{min}$, runs along the top 80% of the face 154 for the largest inclination angle, and runs along intermediate arcs for intermediate inclination angles $\theta_{max}$. This can provide better support and control of the reciprocation of the rod 15.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A surface pumping unit operable with a motive force for reciprocating a rod load for a downhole pump in a well, the well having a wellbore axis intersecting at an inclination relative to the surface of the ground, the unit comprising:

a frame disposed at the surface and having a fulcrum point; and a beam having a first straight section at a first end of the beam and having a second straight section at a second end of the beam, the first and second straight sections defining a bend therebetween, the first end having a head connected to the rod load extending from the well at the inclination, the head having a face circumscribing a segment at a radius relative to the fulcrum point, the segment being tangential to a plurality of inclination angles for the inclination of the wellbore axis, the beam pivotable at a pivot on the fulcrum point of the frame, the pivot disposed on the first straight section between the bend and the first end of the beam, the second end of the beam having a beam bearing point operably connected to the motive force, the beam bearing point configured to pivot the beam about the pivot on the fulcrum point of the frame, wherein the pivot is aligned with a midpoint of the face along a first line perpendicular to the segment, and wherein the beam bearing point is aligned with the pivot along a second line at an acute angle relative to the first line.

2. The unit of claim 1, wherein the frame comprises:

a base disposed at the surface; and a post extending from the base to the fulcrum point along an axial line from vertical, wherein the first straight section is angled to intersect the axial line of the post at an acute forward angle, wherein orientation of the post, the first straight section, and the pivot support a load of the beam with a force along the axial line reducing bending stress on the post.

3. The unit of claim 1, wherein the unit is disposed at one of a plurality of horizontal offsets from the intersection of the wellbore axis with the surface; and wherein the face disposed with the base at the horizontal offsets accommodates the plurality of inclination angles for the inclination of the wellbore axis.

4. The unit of claim 1, wherein the face has a top end where the segment of the face terminates and has a bottom end where the segment of the face terminates; wherein at least seventy-percent or greater of a first portion of the face, measured from the top end toward the bottom end, tangentially intersects the rod load along the wellbore axis for a largest of the plurality of inclination angles of the inclination; and wherein at least seventy-percent or greater of a second portion of the face, measured from the bottom end toward the top end, tangentially intersects the rod load along the wellbore axis for a smallest of the plurality of inclination angles of the inclination.

5. The unit of claim 1, wherein the fulcrum point is disposed at a first vertical height (H) above the surface and disposed at a horizontal offset from the intersection of the wellbore axis with the surface.

6. The unit of claim 1, wherein the pivot comprises a saddle bearing.

7. The unit of claim 1, wherein the first straight section has a first length, wherein the second straight section has a second length, and wherein the bend defines a bend angle between the first and second straight sections and inclining the first straight section downward toward the frame.

8. The unit of claim 1, further comprising:

a prime mover disposed adjacent the frame and operable to provide the motive force;

a crank arm connected to the prime mover and rotatable thereby about a crank point, the crank point disposed at a first (K) dimension relative to the fulcrum point; and a pitman arm having a second (P) dimension and connected between a crank bearing point on the crank arm and the beam bearing point on the second end of the beam, the crank bearing point disposed at a third (R) dimension from the crank point, the beam bearing point disposed at a fourth (C) dimension relative to the fulcrum point, whereby the crank arm rotated by the prime mover about the crank point translates the pitman arm to oscillate the beam on the fulcrum point and reciprocates the rod load along the wellbore axis.

9. The unit of claim 8, wherein the crank bearing point comprises a crank pin bearing; and wherein the beam bearing point comprises an equalizer bearing.

10. The unit of claim 8, wherein the crank arm comprises a counterweight disposed thereon, the crank bearing point being disposed between the counterweight and the crank point.

11. The unit of claim 8, wherein the unit is disposed at one of a plurality of horizontal offsets from the intersection of the wellbore axis with the surface; and wherein the unit having the first, second, third, and fourth dimensions and disposed at the horizontal offsets accommodates the plurality of inclination angles for the inclination of the wellbore axis.

12. The unit of claim 8, wherein the unit having the first, second, third, and fourth dimensions operates at the inclination of the wellbore axis inclined from the surface comparable to a pumping unit having the first, second, third, and fourth dimensions that operates at a vertical wellbore axis.

13. The unit of claim 8, further comprising:

another crank arm connected to the prime mover and rotatable thereby about another crank point, the other crank point disposed at the first (K) dimension relative to the fulcrum point; and another pitman arm having the second (P) dimension and connected between another crank bearing point on the other crank arm and the beam bearing point on the second end of the beam, the other crank bearing point disposed at the third (R) dimension from the other crank point.

14. The unit of claim 13, wherein the pitman arms connect with an equalizer bar at the beam bearing point.

15. The unit of claim 1, wherein the beam bearing point is disposed at a first dimension (C) along the second line from the pivot on the fulcrum point, and wherein the unit has a second dimension (A) along a third line of the radius extending between the pivot and a point on the face at which the inclination of the wellbore axis is tangent.

16. The unit of claim 15, wherein the second dimension (A) is greater than the first dimension (C).

17. A surface pumping unit operable with a motive force for reciprocating a rod load for a downhole pump in a well, the well having a wellbore axis intersecting at an inclination relative to the surface of the ground, the unit comprising:

a base disposed at the surface at one of a plurality horizontal offsets from the intersection of the wellbore axis with the surface;

a post extending from the base to a fulcrum point along an axial line from vertical;

a beam having first and second ends and defining a bend therebetween, the beam pivotable at a pivot on the fulcrum point of the post, the pivot disposed between the bend and the first end of the beam, the first end of the beam having a straight section at the pivot of the fulcrum point, the straight section angled to intersect the axial line of the post at an acute forward angle, the second end of the beam having a beam bearing point operably connected to the motive force, the beam bearing point configured to pivot the beam about the pivot on the fulcrum point of the frame; and a head disposed on the first end of the beam and connected to the rod load extending from the well at the inclination, the head having a face circumscribing a segment at a radius relative to the fulcrum point, the segment being tangential to a plurality of inclination angles for the inclination of the wellbore axis, the face disposed with the base at the horizontal offsets accommodating the plurality of inclination angles for the inclination of the wellbore axis, wherein the pivot of the beam is aligned with a midpoint of the face along a first line perpendicular to the segment, and wherein the beam bearing point is aligned with the pivot along a second line at an acute angle relative to the first line.

18. The unit of claim 17, wherein the face has a top end where the segment of the face terminates and has a bottom end where the segment of the face terminates; wherein at least seventy-percent or greater of a first portion of the face, measured from the top end toward the bottom end, tangentially intersects the rod load along the wellbore axis for a largest of the plurality of inclination angles of the inclination; and wherein at least seventy-percent or greater of a second portion of the face, measured from the bottom end toward the top end, tangentially intersects the rod load along the wellbore axis for a smallest of the plurality of inclination angles of the inclination.

19. The unit of claim 17, wherein the unit is disposed at one of a plurality of horizontal offsets from the intersection of the wellbore axis with the surface; and wherein the face disposed with the base at the horizontal offsets accommodates the plurality of inclination angles for the inclination of the wellbore axis.

20. A reciprocating pump system for a well having a wellbore axis intersecting at an inclination relative to the surface of the ground, the system operable with a motive force, the system comprising:

a downhole pump disposed in the well; and a pumping unit disposed at the surface and coupled to the downhole pump by a rod string, the unit comprising:

a frame disposed at the surface and having a fulcrum point;

a beam having first and second ends and defining a bend therebetween, the first end connected to the rod load extending from the well at the inclination, the beam pivotable at a pivot on the fulcrum point of the frame, the pivot disposed between the bend and the first end of the beam, the second end of the beam having a beam bearing point operably connected to the motive force, the beam bearing point configured to pivot the beam about the pivot on the fulcrum point of the frame; and a head disposed on the first end of the beam and having a face circumscribing a segment at a radius relative to the fulcrum point, wherein the pivot of the beam is aligned with a mid-point of the face along a first line perpendicular to the segment, and wherein the beam bearing point is aligned with the pivot along a second line at an acute angle relative to the first line.

21. The system of claim 20, wherein the face has a top end where the segment of the face terminates and has a bottom end where the segment of the face terminates; wherein at least seventy-percent or greater of a first portion of the face, measured from the top end toward the bottom end, tangentially intersects the rod load along the wellbore axis for a largest of a plurality of inclination angles of the inclination; and wherein at least seventy-percent or greater of a second portion of the face, measured from the bottom end toward the top end, tangentially intersects the rod load along the wellbore axis for a smallest of the plurality of inclination angles of the inclination.

22. The unit of claim 20, wherein the unit is disposed at one of a plurality of horizontal offsets from the intersection of the wellbore axis with the surface; and wherein the face disposed with the base at the horizontal offsets accommodates the plurality of inclination angles for the inclination of the wellbore axis.

* * * * *